US006213854B1

(12) United States Patent
Gegenheimer

(10) Patent No.: US 6,213,854 B1
(45) Date of Patent: Apr. 10, 2001

(54) CENTRIFUGAL FORCE SLIDING GRINDING MACHINE WITH GAP ADJUSTMENT

(76) Inventor: Helmut Gegenheimer, Rebenstr. 6, D-75210 Keltern-Dietlingen (DE)

( * ) Notice: Subject to any disclaimer, the term of this patent is extended or adjusted under 35 U.S.C. 154(b) by 0 days.

(21) Appl. No.: 09/400,329

(22) Filed: Sep. 21, 1999

(30) Foreign Application Priority Data

Sep. 22, 1998 (DE) ..... 198 43 366

(51) Int. Cl.[7] ..... B24B 31/00
(52) U.S. Cl. ..... 451/326; 451/327
(58) Field of Search ..... 451/326, 327, 451/328, 329, 119, 85, 86

(56) References Cited

U.S. PATENT DOCUMENTS 4,939,871 7/1990 Ditscherlein .
5,012,620 5/1991 McNeil .
5,189,842 3/1993 Kobayashi et al. .

FOREIGN PATENT DOCUMENTS 0 791 430 2/1997 (EP) .

*Primary Examiner*—Derris H. Banks
(74) *Attorney, Agent, or Firm*—McGlew and Tuttle, P.C.

(57) ABSTRACT

A centrifugal force sliding grinding machine comprising a stationary container part and a rotary-mounted base part driven with a drive motor and positioned below the stationary container part, as well as an arrangement for adjusting the gap width between the stationary container part and the base part is characterized in that the stationary container part has at least one expansion element preferably located in an elastic container lining for adjusting the gap width. The centrifugal force sliding grinding machine according to the invention can in particular be provided externally of the base part with a storage area for receiving a working fluid introduceable under a predetermined pressure into the gap.

10 Claims, 1 Drawing Sheet

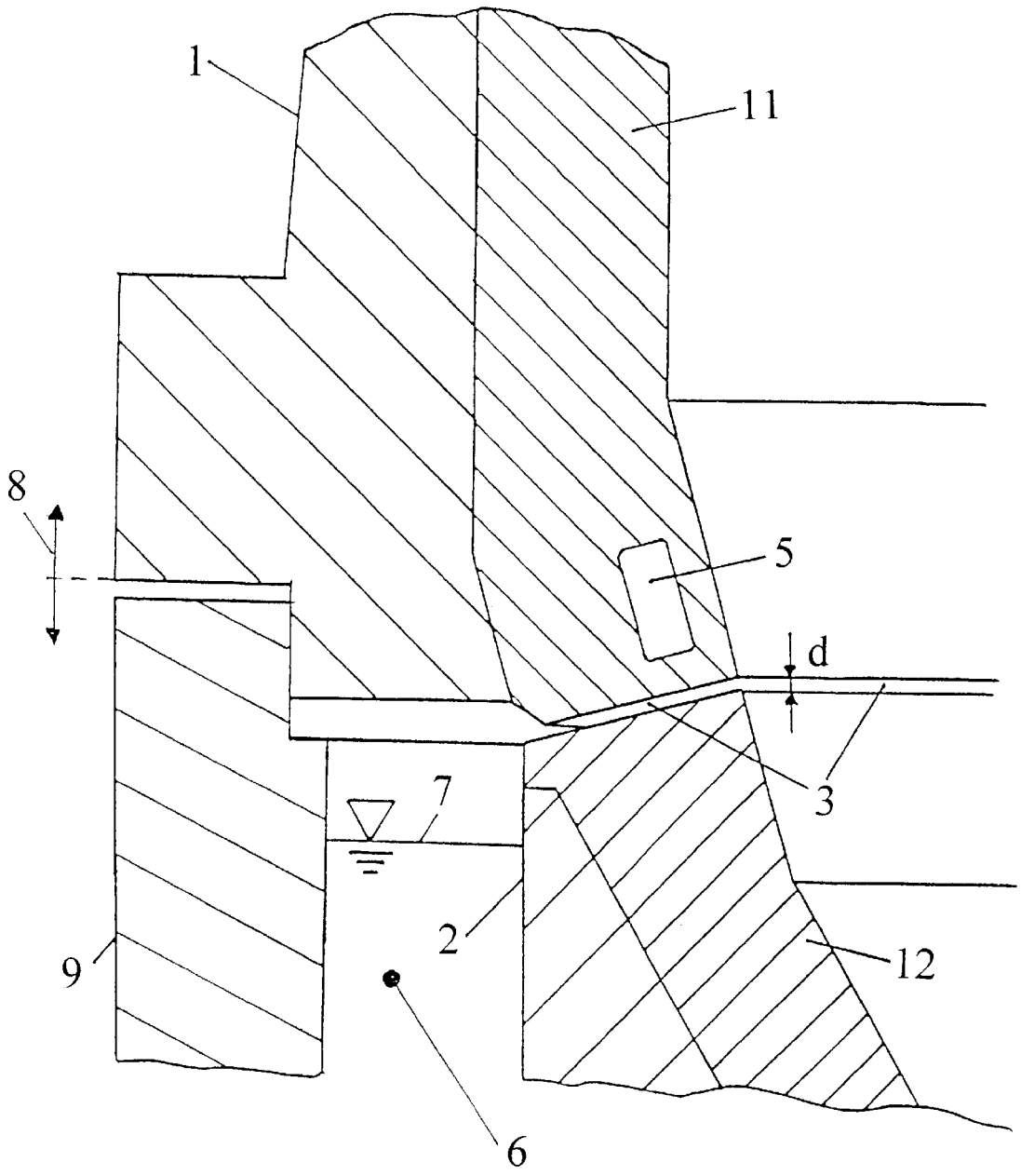
1
11
8
5
d
3
7
2
9
12
6

CENTRIFUGAL FORCE SLIDING GRINDING MACHINE WITH GAP ADJUSTMENT

FIELD OF THE INVENTION

The invention relates to a centrifugal force sliding grinding machine, comprising a stationary container part, a base part driven with a drive motor, mounted in rotary manner and placed below the stationary container part, as well as an arrangement for maintaining the gap width between the stationary container part and the base part.

BACKGROUND OF THE INVENTION

Such centrifugal force sliding grinding machines, e.g. for the final treatment of bulk items such as screws, needles or articles of jewellery are known and used in large numbers. A base part forming the bottom of the container rotates with respect to a stationary container part, so that there is a relative movement between these two parts, which leads to a corresponding rotationally symmetrical flow in the container. The two parts are conventionally separated from one another by an annular clearance or annular gap, in order on the one hand to avoid wear between the two parts moved relative to one another and also for conducting working fluid into the container, particularly in the case of wet machining. The working fluid is introduced into the container in that a storage area is provided, which is supplied with working fluid at a predetermined pressure, so that said fluid can be brought into the container. It is removed from there by means of a central drain in the vicinity of the base part. Attempts have admittedly already been made to ensure that the gap is as small as possible, so that grinding or polishing materials are not pressed outwards by the rotary movement through the gap, but a gap of at least approximately 0.2 to 0.5 mm is still necessary, so that no thin workpieces can be machined, workpieces are damaged by jamming in the gap and the grinding and polishing article must drop below a certain size.

An introduction of such grinding or polishing materials into the gap leads to wear both to the stationary container part and to the base part, which can evolve progressively with increasing gap width, because with increasing wear ever larger particles enter the gap and simultaneously have grinding effects on both gap faces. To reduce this wear in the gap and therefore increase the service life of the base part, it is e.g. known to vary the gap width by a central gap arrangement means located at the drive shaft of the base part (DE 43 11 689 A1). However, such a gap adjustment requires the maintaining of close tolerances in the area of the thrust bearing clearance of the drive shaft and is consequently expensive.

DE 195 42 541 discloses a centrifugal force sliding grinding machine, whose gap is closed under the action of an elastic means, such as a sliding packing, sealing lip or spring, so that the passage of working fluid during wet machining is determined as a function of the pressure thereof against the force of the elastic means determines the gap width. However, it is disadvantageous in such a centrifugal force sliding grinding machine that the annular gap both during dry machining and when machining bulk items, whose diameter is large compared with the gap width, so that no container wear can take place through bulk material penetrating the gap, is closed by the elastic means, so that the latter sliding along the rotating base part is subject to constant wear and the drive motor of the base part constantly starts up against a frictional resistance.

OBJECTS OF THE INVENTION

The object of the invention is to so construct a centrifugal force sliding grinding machine of the aforementioned type that the gap width between the stationary container part and the base part mounted in rotary manner can be precisely varied in a simple and therefore inexpensive manner.

SUMMARY OF THE INVENTION

According to the invention, this problem is solved by a centrifugal force sliding grinding machine of the aforementioned type, in that the stationary container part has at least one expansion element placed in an elastic container lining for adjusting the gap width.

The expansion element preferably located in the area of the lower face of an elastic inner lining of the stationary container part can e.g. extend in annular manner around the circumference of the stationary container part or several expansion elements can be distributed round the circumference of the stationary container part.

Such an expansion element has the advantage that the gap width can be continuously varied up to a complete closure of the gap from a width fixedly predetermined by the bearing of the rotary-mounted base part as a result of the expansion thereof and the associated expansion of the elastic container lining, which can e.g. be made from elastomers. Such a gap adjustment is independent of the pressure of a working fluid which may be introduced through the gap into the container, so that both parameters, namely the gap width and the working fluid pressure, are adjustable separately from one another.

The expansion element according to the invention can e.g. substantially comprise a cavity for receiving a pressurized fluid, which is forced into the cavity by regulatable pneumatic or hydraulic pumps, so that the expansion element expands as a function of the pressure of the fluid introduced. With such an expansion element it is e.g. also possible, by evacuating the cavity to slightly increase the gap width, so as to be able to clean the gap during the service life of the centrifugal force sliding grinding machine.

However, the expansion element can also be a mechanical expansion or spreading element and is then substantially made from metal, in that it e.g. has two different metals or alloys with different thermal expansion coefficients interconnected in the manner of a bimetallic strip, so that it can e.g. be expanded by a variable energization of a heating coil surrounding the expansion element.

The expansion element according to the invention is in particular also suitable for those centrifugal force sliding grinding machines, which on the outside of the base part have a storage area for receiving working fluid introduceable into the gap under a predetermined pressure for the wet machining of bulk products. As has already been stated, in such a centrifugal force sliding grinding machine both the gap width and also the working fluid pressure can be varied separately of one another.

BRIEF DESCRIPTION OF THE DRAWING

The invention is described in greater detail hereinafter relative to a preferred embodiment and with reference to the single drawing in the form of a detail section through the container of a centrifugal force sliding grinding machine in the vicinity of the annular gap between the stationary container part and the rotary base part.

DETAILED DESCRIPTION OF THE DRAWING

The centrifugal force sliding grinding machine shown in FIG. 1 has a stationary container part 1 and a base part 2 mounted in rotary manner and driven by a drive motor, both of which are provided with an inner lining 11, 12. Between the container part 1 and base part 2 is formed a clearance or gap 3 of width d in the form of an annular clearance or gap, which in the construction shown, if necessary, permits the passage of a working fluid 7. The working fluid 7 is stored in a storage area 6, surrounded by the container wall 9, and placed outside the base part 2, and can be supplied to the gap 3 with a predetermined pressure.

The gap width d is variable by means of the inventive expansion element 5 located in the elastic container lining 11, in that e.g. the expansion element 5 constructed as a cavity is supplied with a fluid under a predeterminable pressure, so that it expands and the elastic container lining 11 consequently reduces the gap width d or completely closes the gap 3.

In special cases the expansion element 5 can also be located in an elastic lining 12 of the rotary base part 2, but in this case the control is complicated whilst maintaining the rotation of the base part 2. Additionally and in known manner the stationary container part 1 can also be mounted in height-adjustable manner in the direction of arrow 8, e.g. by means of a serrated slat having locking grooves.

What is claimed is:

1. A centrifugal force sliding grinding machine comprising:

a stationary container part;

a rotary mounted base part disposed below said stationary container part with a gap having a gap width between said stationary container part and said base part;

a drive motor for driving said rotary mounted base part;

an elastic lining provided for one of said stationary container part and said rotary mounted base part; and an arrangement for adjusting said gap width including an expansion element, for adjusting the gap width, embedded in said elastic lining.

2. A centrifugal force sliding grinding machine according to claim 1, wherein said stationary container part has a circumference and said expansion element extends in an annular manner around said circumference of said stationary container part.

3. Centrifugal force sliding grinding machine according to claim 1, further comprising additional expansion elements, said stationary container part has a circumference, said additional expansion elements and said expansion element being arranged around said circumference of said stationary container part.

4. A centrifugal force sliding grinding machine according to claim 1 or 2, wherein said expansion element substantially comprises a cavity for receiving a pressurized fluid.

5. A centrifugal force sliding grinding machine according to claim 4, wherein said expansion element is located in an elastic lining of said stationary container part.

6. A centrifugal force sliding grinding machine according to claim 1 or 2, wherein said expansion element is a mechanical expansion or spreading element.

7. A centrifugal force sliding grinding machine according to claim 6, wherein the expansion element is substantially made from metal.

8. A centrifugal force sliding grinding machine according to claim 6, wherein said expansion element is located in an elastic lining of said stationary container part.

9. A centrifugal force sliding grinding machine according to claim 1, or 2 or 3, 7, wherein said expansion element is located in an elastic lining of said stationary container part.

10. A centrifugal force sliding grinding machine according to claim 1 or 2, further comprising:

a storage area, outside said base part, for receiving a working fluid into said gap, said working fluid being regulatable to a predetermined pressure.

* * * * *